US012798871B2

(12) United States Patent
George et al.

(10) Patent No.: US 12,798,871 B2
(45) Date of Patent: Nov. 17, 2026

(54) SYSTEM FOR MONITORING TRANSPORT AND STORAGE OF PARTS FOR OPTIMIZING A MANUFACTURING PROCESS

(71) Applicant: SONACA S.A., Gosselies (BE)

(72) Inventors: Nicolas George, Thiant (FR); Michel Fievet, Stree (BE)

(73) Assignee: SONACA S.A., Gosselies (BE)

( * ) Notice: Subject to any disclaimer, the term of this patent is extended or adjusted under 35 U.S.C. 154(b) by 114 days.

(21) Appl. No.: 18/847,951

(22) PCT Filed: Mar. 17, 2023

(86) PCT No.: PCT/EP2023/056891
§ 371 (c)(1),
(2) Date: Sep. 17, 2024

(87) PCT Pub. No.: WO2023/180200
PCT Pub. Date: Sep. 28, 2023

(65) Prior Publication Data

US 2025/0206520 A1 Jun. 26, 2025

(30) Foreign Application Priority Data

Mar. 22, 2022 (BE) ..... 2022/5202

(51) Int. Cl.
*B65D 85/68* (2006.01)
*B65D 90/00* (2006.01)
*B65D 90/48* (2006.01)

(52) U.S. Cl.
CPC ..... *B65D 85/68* (2013.01); *B65D 90/48* (2013.01); *B65D 90/0073* (2013.01); *B65D 2585/687* (2013.01); *B65D 2590/005* (2013.01)

(58) Field of Classification Search
CPC .... B65D 85/68; B65D 90/48; B65D 90/0073; B65D 2585/687; B65D 2590/005
See application file for complete search history.

(56) References Cited

U.S. PATENT DOCUMENTS 7,002,472 B2 * 2/2006 Stratmoen ..... G06Q 10/08 340/568.1
11,750,008 B2 * 9/2023 Neeld ..... G06Q 10/087 709/223

(Continued)

FOREIGN PATENT DOCUMENTS

EP 2017106324 A1 6/2017
WO 2004110180 A1 12/2004
WO 2016008530 A1 1/2016

OTHER PUBLICATIONS

Corresponding International Patent Application No. PCT/EP2023/056891, International Search Report, date mailed May 24, 2023.

(Continued)

*Primary Examiner* — John A Tweel, Jr.
(74) *Attorney, Agent, or Firm* — McDonald Hopkins LLC

(57) ABSTRACT

A transport container is provided for a system for detecting a flow of parts. The container comprises a first holder comprising a first specific shape for receiving a first part type to be transported, a first detector for detecting a state of occupancy of the first holder, and a detector of a geolocation of the container and a controller configured to transmit an identifier of the container together with the state of occupancy of the first holder and the geolocation. A system for detecting a flow of parts is also provided, the system comprising a container as described before. A method for managing the flow of parts implementing said system is also described.

15 Claims, 7 Drawing Sheets

(56) References Cited

U.S. PATENT DOCUMENTS

| | | | | |
|---|---|---|---|---|
| 12,333,479 | B2 * | 6/2025 | Conlon | G06Q 10/0833 |
| 2004/0142603 | A1 * | 7/2004 | Walker | H10W 90/00 439/701 |
| 2015/0053842 | A1 | 2/2015 | Phelan et al. | |

OTHER PUBLICATIONS

Corresponding International Patent Application No. PCT/EP2023/056891, Written Opinion date mailed May 24, 2023.

* cited by examiner

210

| | | | | | | | |
|---|---|---|---|---|---|---|---|
| A-237 | D | 240-L = 0 | 250-L = 1 | 260-L = 1 | 240-R = 0 | 250-R = 1 | 260-R = 1 |
| A-238 | D | 240-L = 1 | 250-L = 1 | 260-L = 1 | 240-R = 1 | 250-R = 1 | 260-R = 1 |
| C-432 | D | 240-L = 1 | 250-L = 1 | 260-L = 1 | 240-R = 1 | 250-R = 1 | 260-R = 1 |

300

230

| | | | | | | | |
|---|---|---|---|---|---|---|---|
| R-227 | T | 240-L = 1 | 250-L = 1 | 260-L = 1 | 240-R = 1 | 250-R = 1 | 260-R = 1 |
| F-938 | T | 240-L = 1 | 250-L = 1 | 260-L = 1 | 240-R = 1 | 250-R = 1 | 260-R = 1 |

220

| | | | | | | | |
|---|---|---|---|---|---|---|---|
| A-241 | A | 240-L = 0 | 250-L = 0 | 260-L = 0 | 240-L = 0 | 250-R = 0 | 260-R = 1 |
| A-263 | A | 240-L = 0 | 250-L = 0 | 260-L = 0 | 240-R = 0 | 250-R = 0 | 260-R = 0 |
| G-773 | A | 240-L = 1 | 250-L = 1 | 260-L = 0 | 240-R = 1 | 250-R = 1 | 260-R = 1 |

FIG. 6

SYSTEM FOR MONITORING TRANSPORT AND STORAGE OF PARTS FOR OPTIMIZING A MANUFACTURING PROCESS

CROSS-REFERENCE TO RELATED APPLICATIONS

This is the National Stage application of PCT international application PCT/EP2023/056891, filed on Mar. 17, 2023, which claims the priority of Belgium Patent Application No. 2022/5202, filed Mar. 22, 2022, both of which are incorporated herein by reference in their entireties.

TECHNICAL FIELD AND PRIOR ART

The present invention relates to a system allowing monitoring a transport of parts and storage thereof in order to optimise a manufacturing process. More specifically, the described system allows optimising, in real-time, a flow of items transported in holder containers. The detection of the parts throughout transport and consumption thereof allows organising sending of new parts as well as a new production of said parts.

DISCLOSURE OF THE INVENTION

Consequently, the present invention aims to provide a transport container for a system for detecting a flow of parts. The container comprises:

- a first holder comprising a first specific shape for receiving a first part type to be transported,
- a first detector for detecting a state of occupancy of the first holder,
- a detector of a geolocation of the container, and
- a controller configured to transmit an identifier of the container together with said state of occupancy of the first holder and said geolocation.

Advantageously, the container comprises a second holder,

- the second holder comprising a second specific shape for receiving a second part type to be transported and a second detector for detecting a state of occupancy of the second holder,
- the first shape being different from the second shape so that the first holder cannot receive the second part type and the second holder cannot receive the first part type,
- the controller being configured to transmit the state of occupancy of the second holder.

The shape that the holder comprises may be a negative of a portion of a slat or a negative of a portion of a droop-nose of an aircraft.

The container may also comprise a plurality of holders,

- each holder comprising a specific shape so as to be able to receive only a particular part type amongst a set of different part types,
- each holder comprising a detector of the occupancy of the holder,
- the controller configured to transmit the state of occupancy of each holder.

The container may be configured to receive a complete set of slats of an aircraft, each holder comprising a specific shape so as to be able to receive only one slat of the set of slats.

Said detector of the state of occupancy of the holder may comprise a mechanical detector and/or an electromechanical detector and/or an optical detector and/or a weight detector and/or a volumetric detector and/or an ultrasonic detector and/or an electromagnetic ray detector,

- the detector being configured to detect said part and/or to be actuated by the part upon reception of said part by the holder.

The geolocation detector may comprise a GPS detector and/or a GSM-TDOA detector.

The container may also comprise a temperature sensor and/or a hygrometry sensor and/or a shock sensor.

The controller may be configured to transmit a temperature and/or a hygrometry and/or a force and/or an acceleration measured by said respective sensor.

A system for detecting a flow of parts may comprise a container as described before and a receiver configured to receive the identifier of the container with the state of occupancy and the geolocation and of

- determining based on the geolocation: a positioning of the container at a starting point or at an end point or at a transit point and/or

- determining based on the identifier of the container and the state of occupancy:
- a presence of a part type, or
- a presence of all types of parts in the container.

The system may comprise a plurality of transport containers, the identifier of each container being unique within the plurality of containers and associated with one single container.

The system may also be configured to notice a risk of damage related to a container. Said risk of damage may be noticed if the temperature and/or the hygrometry and/or the force and/or the acceleration measured by said respective sensor exceeds a threshold, preferably the system being configured to trigger an inspection of the container and/or of a content of the container in the case where said risk of damage has been noticed.

The system may also be configured to detect a part returned by a customer by performing the steps of:

- determining a positioning of the container,
- while the container keeps a positioning at the end point:
- determining an absence of a part type in said container and then
- determining a presence of said part type in said container.

The system may be configured to manage an amount of flow of parts by performing the steps of:

- determining a number of containers with a positioning at the end point and determining the types of parts present in each of said containers,
- comparing a set of said types of parts with a threshold,
- increasing a flow of parts from the starting point to the end point if all of said part types are below said threshold.

A method for managing a flow of parts may implement the system as described before. The system may comprise a plurality of transport containers. The method may comprise the steps of:

- determining a set of containers with a positioning at an end point,
- in said set of containers determining a number of states of occupancy changing from a presence state into an absence state for a given time period,
- determining a flow of desired parts from the starting point to the end point based on said change.

Furthermore, the method may comprise the step of

- determining in said set of containers with a positioning at the end point a number of states of occupancy displaying an absence state, in the case where said number is above a given threshold: Increasing a production of part types corresponding to the holders with said absence state.

BRIEF DESCRIPTION OF THE DRAWINGS

The present invention will be better understood based on the following description and the appended drawings wherein:

FIG. 6 shows an example of flow detection performed by the system.

DETAILED DISCLOSURE OF PARTICULAR EMBODIMENTS

Figure 1:
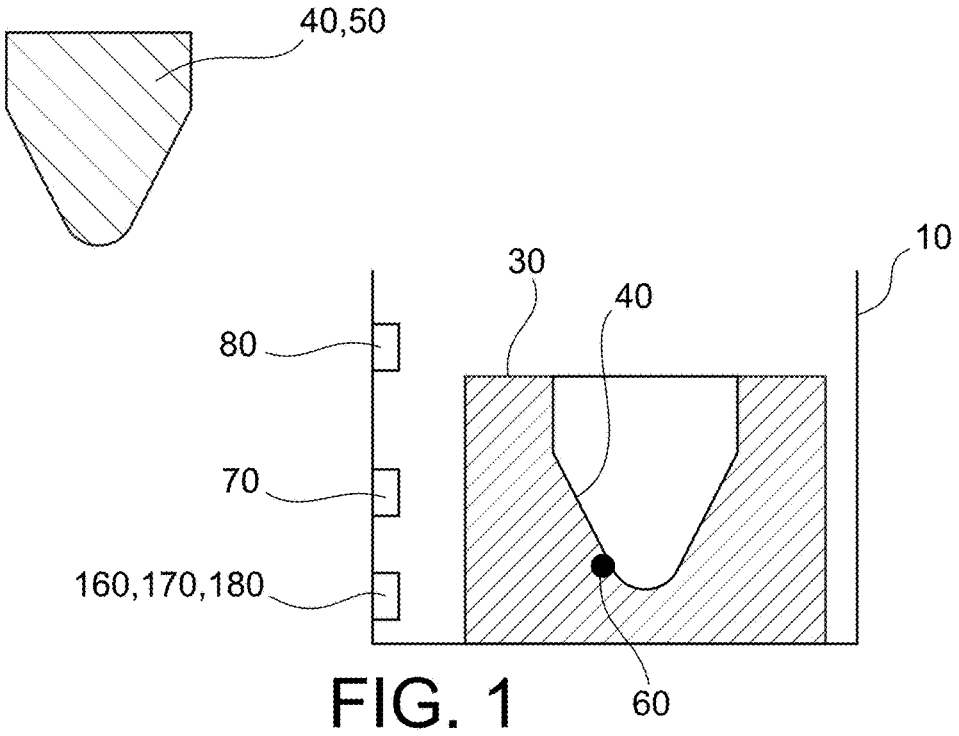
FIG. 1 shows a transport container for a system for detecting a flow of parts.

FIG. 1 shows a transport container (10) for a system for detecting a flow of parts. The container comprises a first holder (30) with a first specific shape (40). A first part type (50) having said first specific shape (40) is also shown.

The container comprises a first detector (60) for detecting a state of occupancy of the first holder, a geolocation detector (70) of the container and a controller (80). The controller is connected to the geolocation detector and to the first state of occupancy detector (60). It is configured to transmit an identifier of the container together with said state of occupancy of the first holder and said geolocation.

Preferably, said identifier is unique for the container. In other words, in the case of a plurality of containers, the identifier of each container is unique within the plurality of containers and associated with one single container. Said identifier may be a number, a letter or a combination of numbers and letters.

Said identifier may also be calculated from the specific shape of the holder.

The first holder is arranged inside the transport container. During transport, the part to be transported (50) is received by the holder so as to be held in a stable manner, without moving.

FIG. 1 shows that the first holder comprises a first specific shape which is adapted to the first part type.

The "part type" is determined by a two-dimensional or three-dimensional shape of at least one portion of the surface of the part. Each individual part corresponds to one single part type.

The first holder may comprise a negative shape of the portion of the surface which determines the part type. In this case, the first holder comprises a negative shape of at least one portion of the surface of the first part type. In other words, the holder forms a negative of a portion of the surface of the part to be transported.

Thus, when the holder receives the part of said first type, the holder conforms to said portion of the surface without leaving any space. Consequently, a tight contact is established between the holder and the surface.

For example, FIG. 1 shows that the conical portion of the part would be received by the holder without leaving any space. In general, the holder "comprises a specific shape for receiving a part type" in the case where at least one portion of the holder comprises a surface shape which establishes a tight contact, without leaving any space, with at least one portion of the surface of the part.

For example, said shape of the holder may be a negative of a portion of a leading-edge movable flap or a negative of a portion of a leading-edge pivoting flap of an aircraft. The English term "slat" will also be used to refer to a leading-edge movable flap. The term "droop-nose" will also be used to refer to a leading-edge pivoting flap, which is also so-called "falling nose".

Thus, the shape of the holder is specific for receiving a particular part type. Since the surface of the holder corresponds to a portion of the surface of the part type, the holder can receive only one single part type. Another part type, by definition having another surface shape, cannot be received. A space would remain between the other part type and the holder, a tight contact would not be established.

Thus, the first holder (30) defines the part type (50) that could be located in the transport container (10). Any other part type cannot be received in a valid or technically proper manner by said container (10).

This specificity of the holder allows finding the part type based on a simple measurement of the occupancy of the holder. In the case where the holder is occupied and/or a presence of a part is detected, this is necessarily the part type that can be received by the specific shape of the holder. Thus, knowing the type of holder or the specific shape of the holder, a presence detected on the holder allows deducing the presence of a particular part type in the container.

For example, in the case where the shape that the holder comprises is a negative of a portion of a slat, the detection of a state of occupancy allows deducing that a slat, of the type that can be received by the holder, is located in the container. Similarly, in the case where the shape that the holder comprises is a negative of a droop-nose, the detection of a state of presence allows deducing the presence, within the container, of a droop-nose, whose shape is adapted to the shape of the holder.

The first detector (60) is arranged in the container so as to detect a state of occupancy of the first holder. Preferably, the first detector may be fastened directly to the holder. Said state of occupancy indicates a presence of a part in the holder or an absence of a part in the holder. Preferably, the first detector determines that a portion of the surface of the part is in contact with a surface of the holder. Since the detection of a mechanical contact between the part to be transported and the holder could be enough to determine said state of occupancy of the holder, said first detector could be technically simple. Advantageously, a contact detector may be used. Such a detector is particularly inexpensive and technically reliable, a measurement error is absent. In other words, in all cases where a part is received by the holder, a presence signal is detected. In all cases where no part is present in the holder, an absence signal is detected. Since the specific shape of the holder unequivocally determines the part type, the presence or absence information allows deducing whether a particular part is present in the container or not.

Said detector of the state of occupancy may comprise a mechanical detector and/or an electromechanical detector and/or an optical detector and/or a weight detector and/or a volumetric detector and/or an ultrasonic detector and/or one electromagnetic ray detector. The detector may be configured to detect said part and/or to be actuated by the part upon reception of said part by the holder.

For example, the detector (60) may be an electrical switch actuated by contact with the surface of the part when the part is validly received by the holder. The detector may also be an optical detector which is covered by the surface of the object when said surface comes into tight contact with the holder.

A remote reception of an identifier of the container, of a geolocation of the container and of a piece of information on the state of occupancy of the first holder allows, at the location of reception of the information, determining a general position of a part of the first type. In other words, based on the simple occupancy, geolocation and identifier information, it is possible to deduce a general position of a particular part.

The identifier of the container allows determining the specific shape of the holder arranged inside the container. For example, a database located at the reception location allows finding the first specific shape of the first holder arranged within the container whose identifier has been received. Based on the specific shape of the holder, it is possible to determine the part type that can be received by the holder. The state of occupancy of the holder allows determining that said part is actually in the container. Afterwards, the geolocation information allows determining the position of the part.

The controller is configured to transmit the identifier of the container together with said state of occupancy of the first holder and said remote geolocation. Thus, upon said remote reception, the flow of parts can be determined as described before.

It is also possible to provide for several holders having the same specific shape within the container. In this case, several parts of the same type can be transported with the transport container.

Figure 2:
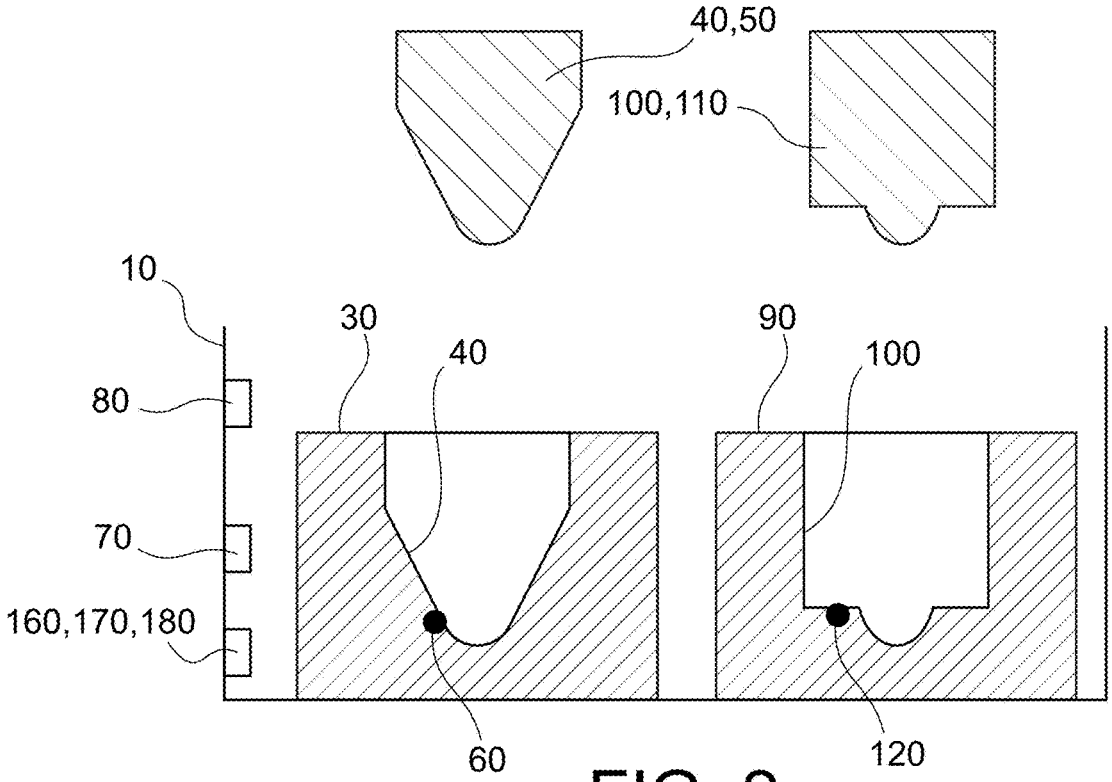
FIG. 2 shows a transport container comprising a second holder.

FIG. 2 shows the elements already described with the description of FIG. 1. The same elements bear the same reference signs.

In addition, the transport container shown in FIG. 2 comprises a second holder (90). The second holder (90) and the first holder (30) are both arranged inside the container. Thus, the container comprises the first and second holders and can transport two parts. The second holder comprises a second specific shape (100) for receiving a second part type (110). FIG. 2 shows the second part type (110) with the second specific shape (100). The second holder also comprises a second detector (120) for determining a state of occupancy of the second holder. As described with reference to the first holder, the second holder can receive only the second part type (110). The specific shape of the second holder (100) is adapted to receive only the second part type to establish a tight contact with at least one portion of a surface of the second part type. Thus, only the second part type can be received in the second holder without leaving any space between the part and the holder. The second holder may comprise a negative shape of at least one portion of the surface of the second part type.

The first shape (40) of the first holder (30) is different from the second form (100) of the second holder (90) so that the first holder cannot receive the second part type and the second holder cannot receive the first part type.

FIG. 2 shows non-limiting examples of part shapes. The first holder (30) cannot receive the part with the second specific shape. In other words, in the case where the part of the second specific shape (100, 110) would be placed in the first holder, the surface of the first holder would not come into tight contact with the surface of the second part. In the illustrated example, the lower portion of the second shape (100) would be stopped on the rim of the cone of the shape of the first holder. A hollow would remain between the second part and the first holder. The part with the second shape would not be validly held by the first holder and cannot be transported. In this case, the presence detector will not be actuated, which will result in a feedback requiring a corrective action. On the contrary, as shown in FIG. 2, the first part with the first specific shape (40) perfectly conforms to the first holder. The surface of the first holder (30) can come into tight contact, without leaving any space, with the first part, having the first specific shape.

The controller is configured to also transmit the state of occupancy of the second holder. In other words, the controller (80) receives from the first detector (60) the state of occupancy of the first holder and from the second detector (120) the state of occupancy of the second holder. Said state of occupancy may indicate a presence of a part in the holder or may indicate an absence of a part in the holder. The controller also receives a geolocation of the geolocation detector. Said geolocation may comprise the coordinates of the terrestrial position of the container. Afterwards, the controller transmits an identifier of the container together with the geolocation and with the first and second states of occupancy.

As described before, a receiver can advantageously deduce, based on the received information, a location of a particular part type or of a particular part as described later on.

The geolocation information allows deducing a location where the container is positioned. The identifier of the container allows deducing the part type that can be received by the first holder and the part type that can be received by the second holder. The occupancy information of the first and second holders allows deducing:

In the case of a detected presence for the first holder, that a part of the first type is located at the location where the container is positioned.

In the case of a detected presence for the second holder, that a part of the second type is located at the location where the container is positioned.

As described before, the specific shape of the holder allows deducing on the simple information on the presence or absence of a specific part at the location where the container is positioned.

Figure 3:
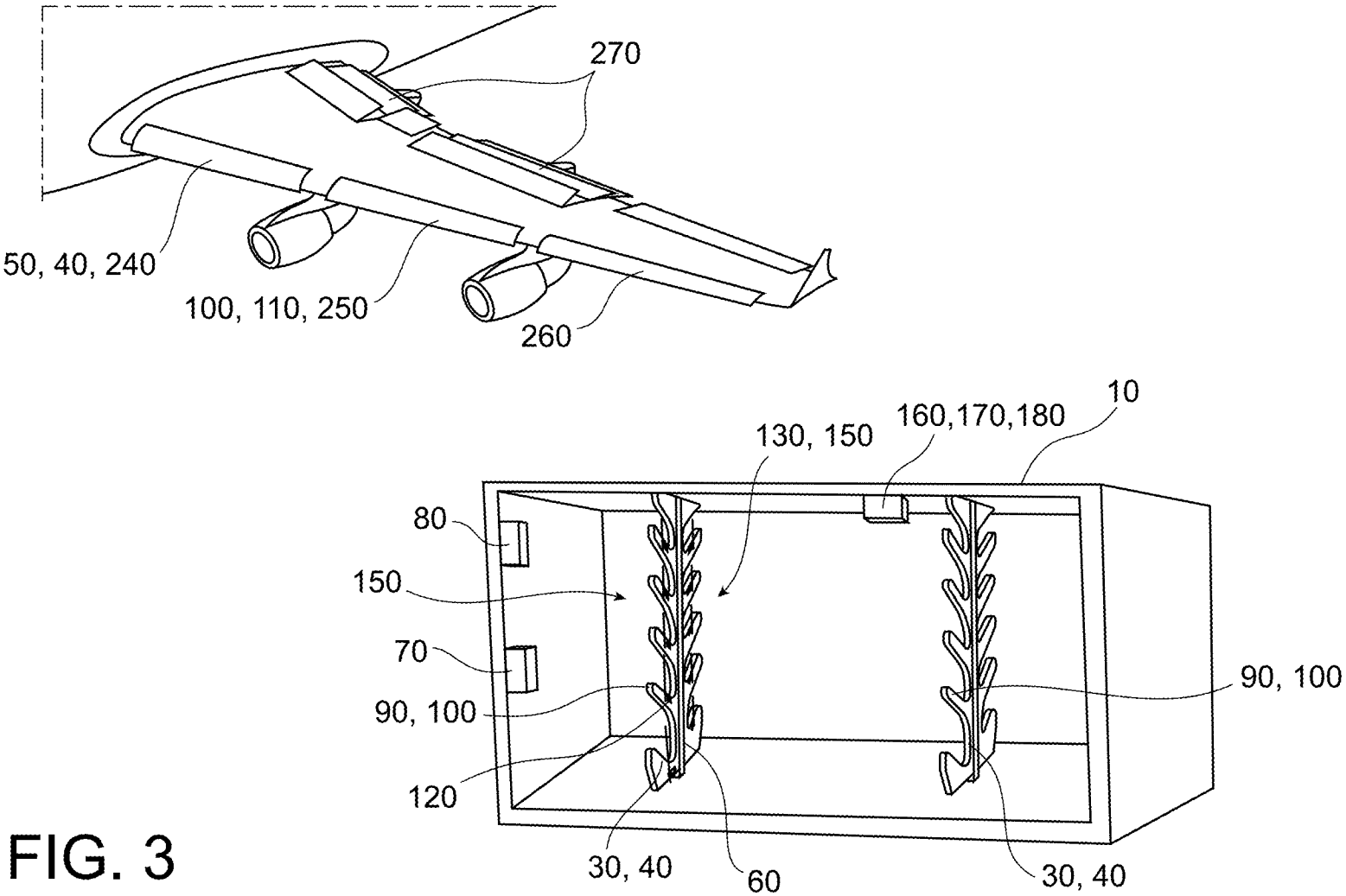
FIG. 3 shows a transport container with a plurality of holders.

FIG. 3 shows the same features described with reference to FIGS. 1 and 2. The same elements bear the same reference signs.

The transport container shown in FIG. 3 comprises a plurality of holders (150). Said plurality of holders comprises the first holder (30) and the second holder (90), described with reference to FIGS. 1 and 2, in addition to other additional holders. Each of the holders comprises a specific shape, as described before for the first and second holders. Said shape of each holder is specific so as to be able to receive only one particular part type amongst a set of different part types. In other words, for any shape of a holder, the holder selected amongst the plurality of holders, is different from the shapes of all of the other holders of the plurality of holders. Thus, the shape of each holder is specific for a specific part type.

For example, a set of parts should be received by the plurality of holders that the container contains. Each part is of a type different from all of the other parts of the set of parts. In other words, each part has a shape different from all of the other parts. In this case, there is only one possibility of distributing the set of parts within the plurality of holders. Because of its shape or its part type, each part corresponds exactly to one single holder amongst the plurality of holders in which it can be stored. No part of said plurality of parts can change its storage location with another part, due to the fact that each holder shape is unique within the plurality of holders. Each holder of the plurality of holders comprises a detector for detecting the occupancy of said holder. The controller (80) of the container transmits the state of occupancy of each holder of the plurality of holders.

In the embodiment shown in FIG. 3, the first part type may be a slat of a wing of an aircraft, for example the inner slat of the left wing (240). The second part type may be the middle slat of the left wing (250). An outer slat of the left wing (260) may be a third part type. Thus, the set of part types may be the set of different slats of a wing of an aircraft. The set of part types may be a complete set of slats of an aircraft, in other words all of the slats of a left wing and of a right wing. In the example shown in the three figures, the complete set of slats comprises the three slats of the left wing (240, 250, 260) and the three slats of the right wing. Each slat has one single shape within the set of slats of the aircraft, no slat can take the place of another slat on the aircraft.

Thus, all of the plurality of holders can be configured to receive a complete set of slats of an aircraft. Each of the slats of the set of slats has one single place within the plurality of holders. Each holder of the plurality of holders has a specific shape configured so as to be able to receive only one single slat of the set of slats of the aircraft.

Alternatively, the plurality of holders that the container contains may be configured to receive other parts, for example a set of trailing-edge flaps or flaps of an aircraft (270), shown in FIG. 3.

As described before, each holder comprises a detector for detecting the occupancy of the holder and the controller is configured to transmit the state of occupancy of each holder.

FIGS. 4*a*, 4*b*, 4*c*, 4*d* and 4*e* show the same elements already described in combination with FIGS. 1 to 3. The same elements are indicated by the same reference signs.

Figure 4A:
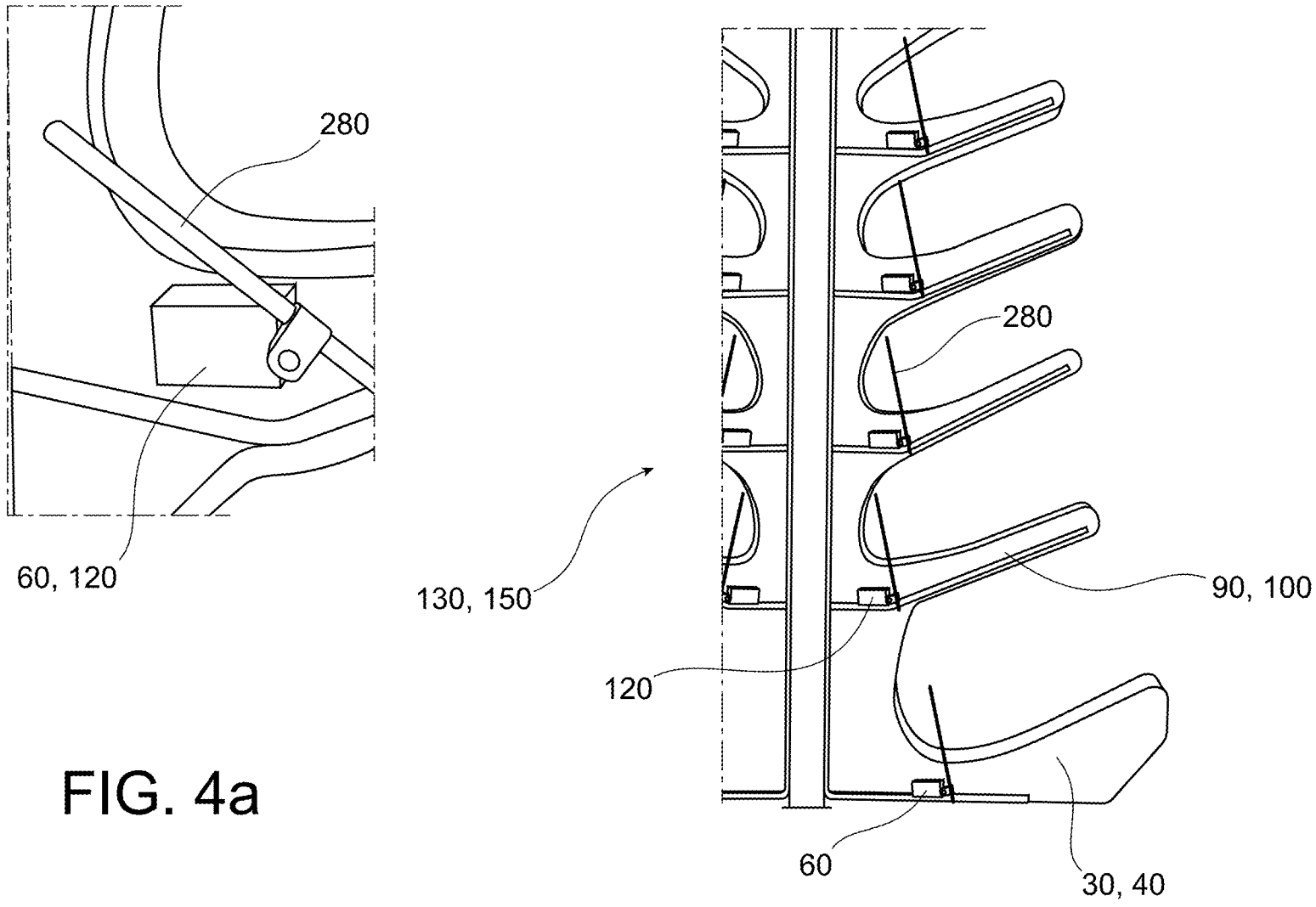
FIGS. 4*a*, 4*b*, 4*c*, 4*d* and 4*e* show a transport container configured to receive a complete set of slats of an aircraft.

The plurality of holders (150) shown in FIG. 4*a* is configured to receive a complete set of slats of an aircraft. Thus, the first holder (30) comprises a specific shape, which is the negative of a portion of a slat (130). In other words, the surface of the first holder has a shape corresponding to a portion of the surface of the slat. When said slat is placed in this holder, the portion of the surface of the slat tightly conforms to the surface of the holder, without leaving any space. Thus, the holder is specific to this one single slat of the set of slats. The second holder (90) comprises a second specific shape, different from the first specific shape of the first holder. For example, FIGS. 4*a*, 4*b*, 4*c*, 4*d* and 4*e* show that the first specific shape of the first holder comprises a larger radius on the left side. The second specific shape (100) of the second holder (90) comprises a smaller radius at the same location. The slat corresponding to the second specific shape can be received only by the second holder (90). In the case where said slat would be placed in the first holder, the shape of the holder would not conform to the surface of the slat. A space would remain between the holder and the slat, the slat would not be properly held and might be damaged during transport. One could also observe, above the second holder (90), other holders of the plurality of holders (150), configured to receive other slats of the set of slats. In the illustrated example, each holder comprises a surface corresponding to a portion of a particular slat of the set of slats. In other words, each slat has its dedicated or unique location within the plurality of holders.

FIG. 4*a* also shows an example of a detector of a state of occupancy of the holder. In the illustrated example, the detector is ensured by an electrical switch. Said switch is mechanically actuated by a bar (280). The slat received by the corresponding holder moves the bar and thus actuates the switch. The actuated switch indicates the presence of the slat in the holder. FIG. 4*a* shows that each holder of the plurality of holders is individually equipped with its electrical switch. Thus, a state of occupancy can be determined for each holder. When the slat is received by the holder, the bar (280) of the detector is necessarily moved and the detector is necessarily actuated. In the case of an empty holder, said bar cannot be actuated and necessarily indicates an absence of parts in the holder. Thus, the detection of the presence or absence is fault-free, with a 100% degree of reliability. The combination of a simple and reliable detector with the specificity of the holder results in a fault-free detectability of a part type, independently of the complexity of the part.

FIGS. 4*b*, 4*c*, 4*d* and 4*e* show in more detail the detector and actuation thereof.

Figure 4B:
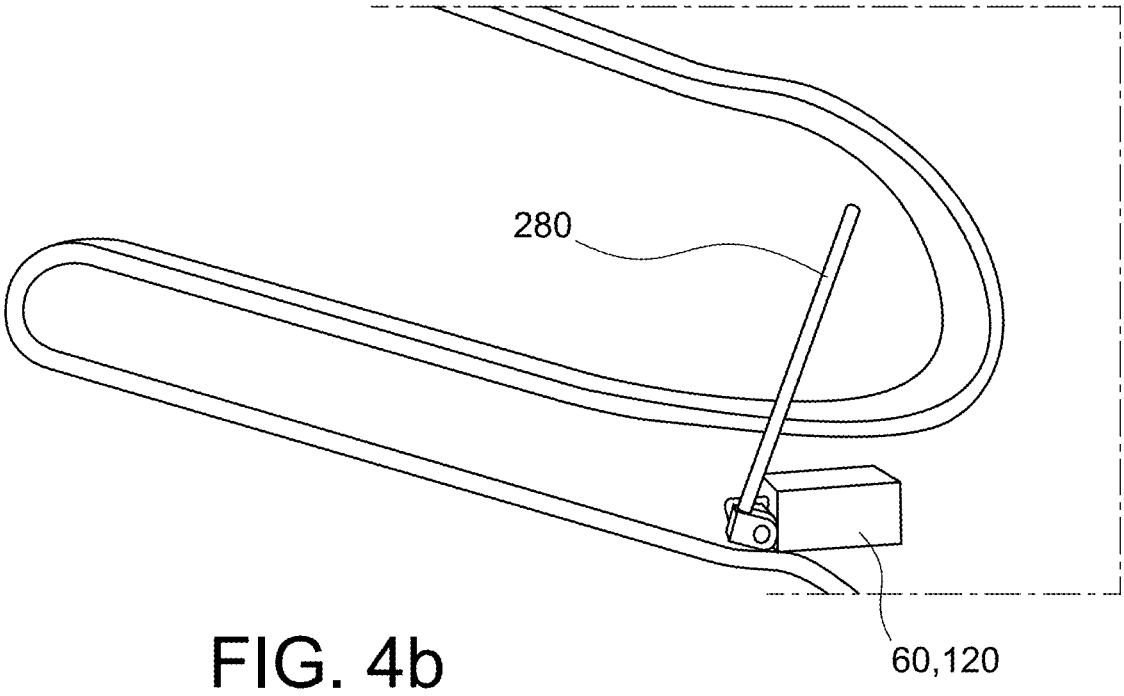
Figure 4C:
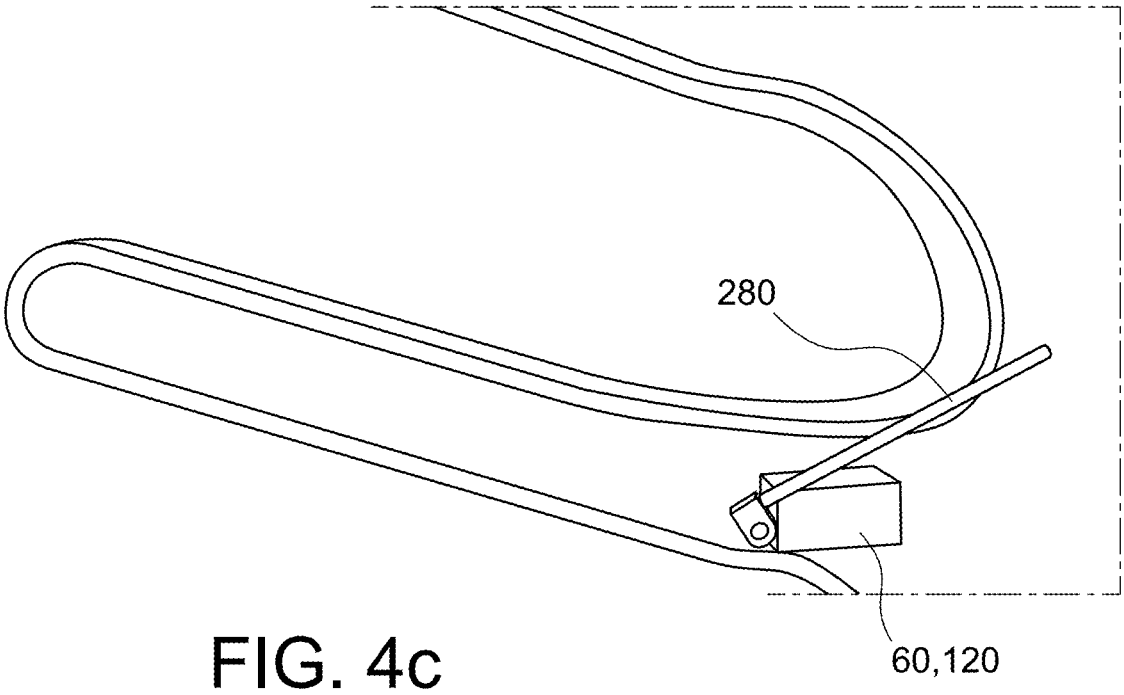

FIG. 4*b* shows the state of occupancy detector (60, 120) in a non-actuated state, corresponding to an absence state of a part in the holder. The bar (280) is in a vertical position, entering a space of the holder. FIG. 4*c* shows the detector (60, 120) in an actuated state, corresponding to a state of occupancy of the holder or a presence state of a part in the holder. Just to improve visibility, the holder is shown empty, without any part. The bar is moved to a horizontal position, clearing access to the holder.

Figure 4D:
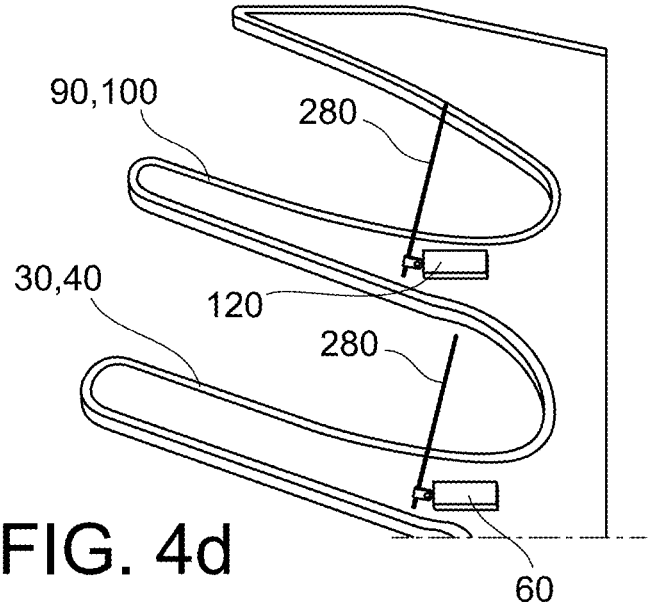

FIG. 4*d* shows the first (30) and second (90) holders with the first (60) and second (120) detectors. Each of the detectors is actuated by its own bar (280). FIG. 4*d* shows the two empty holders and the detectors in a position corresponding to an absence of parts.

Figure 4E:
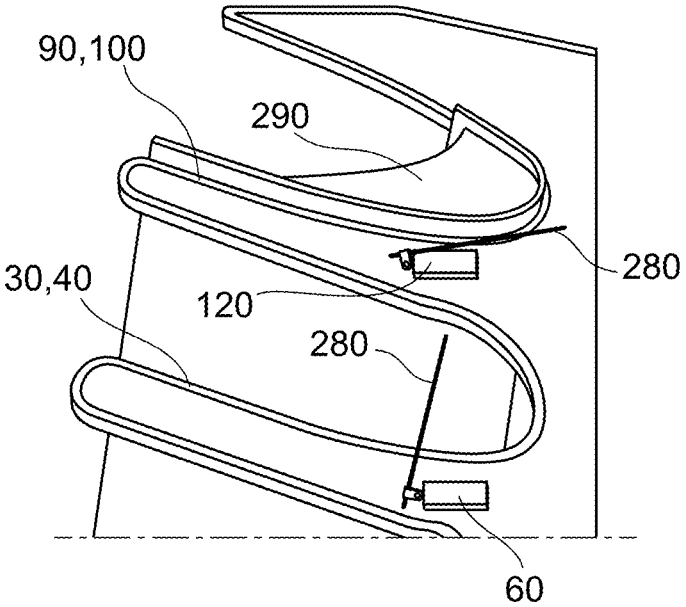

FIG. 4*e* shows a slat (290) received by the second holder. The first holder is empty, as already shown in FIG. 4*d*. The slat (290) has pushed the bar (280) and thus actuated the second detector. Thus, the second detector indicates a presence of a part in the second holder while the first detector indicates an absence of a part in the first holder.

The geolocation detector shown in FIGS. 1, 2 and 3 may comprise a satellite location detector. For example, such a detector may use a signal from the GPS, GLONASS system or others. The geolocation detector may also comprise a GSM-TDOA detector which determines a position from terrestrial telecommunication signals. Preferably, the geolocation detector comprises a plurality of detectors and is configured to determine a position from an available signal type or several available signal types.

For example, the controller uses a wireless telecommunication network to transmit the geolocation, the identifier of the container and the states of occupancy. For example, the controller may use a GSM network and/or a WIFI network and/or a Bluetooth network and/or a satellite communication network to transmit said information.

As shown in FIGS. 1, 2 and 3, the transport container may also comprise a temperature sensor (160) and/or a hygrometry sensor (170) and/or a shock sensor (180). Thus, the controller is configured to transmit a temperature and/or a hygrometry and/or a force and/or an acceleration measured by said respective sensor, together with the other information described hereinabove. The temperature, hygrometry, force and/or acceleration measurements related to the container or inside the container allow detecting a risk of damage to the container and/or to the content transported by the container, as will be described later on.

Figure 5:
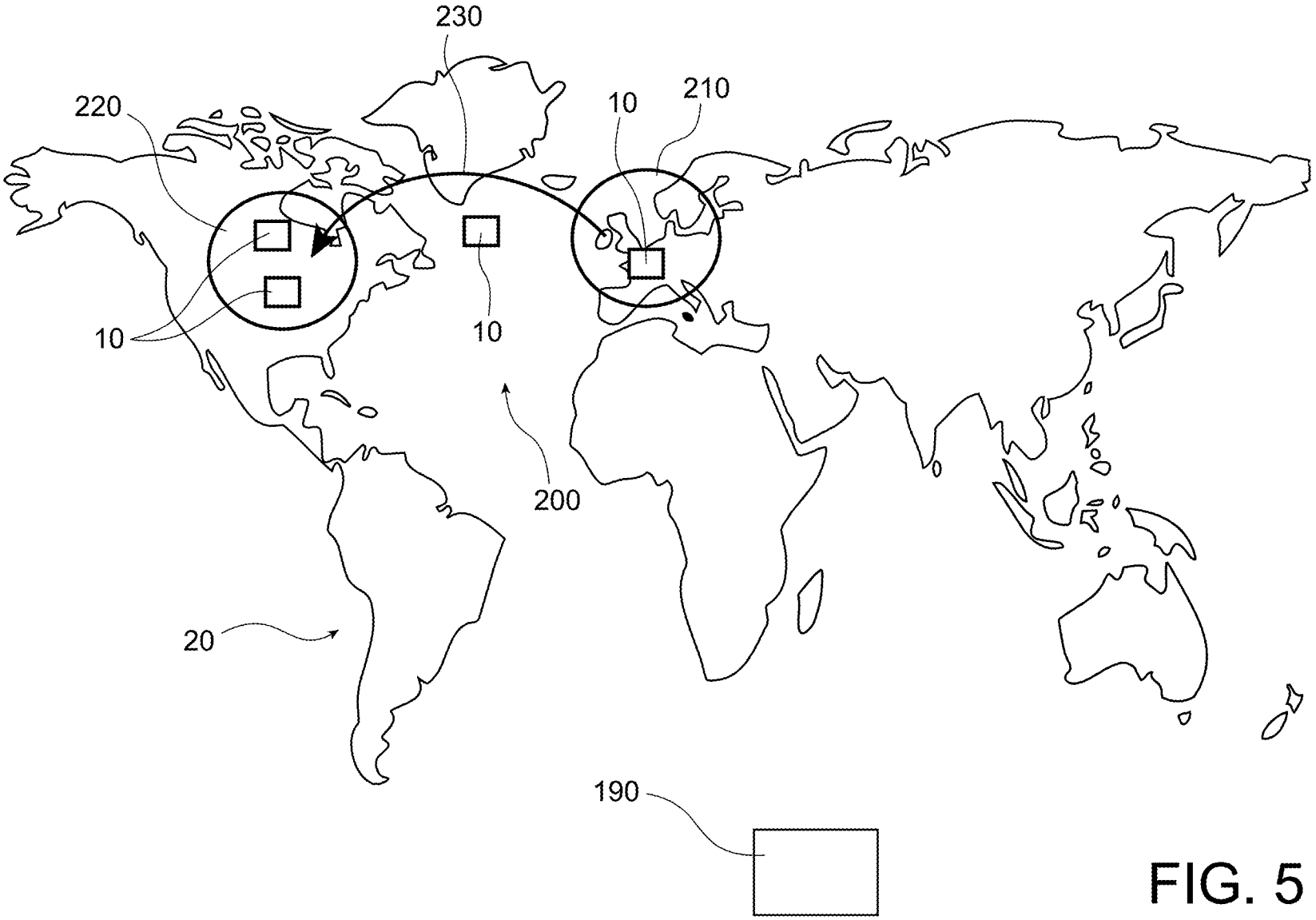
FIG. 5 shows a system for detecting a flow of transported parts.

FIG. 5 shows a system (20) for detecting a flow of transported parts.

By a flow of parts, we understand a first number of a first part type located at a starting point (210), a second number of the first part type located at a transit point (230) and a third number of the first part type located at an end point (220).

Said flow may also comprise the numbers indicated hereinabove for a second part type and also for other types of parts. Said flow may also comprise a number of a part type arriving at the end point per unit of time and/or a number of a part type departing from the starting point per unit of time.

The system may comprise one or more transport container (s) (10) as described before. The system also comprises a receiver (190) configured to receive a transmission emitted by the controller of the container or by the different controllers of the different containers. In particular, the receiver is configured to receive from each container: the identifier of the container, the state of occupancy of each of the holders within said container and the geolocation of said container.

For example, the system may comprise several containers as shown in FIGS. 3 and 4. Thus, it consists of a system for detecting and managing a flow of slats from a starting point towards an end point and storage thereof. More specifically, the starting point may be a slat production site. The end point may be an assembly site of an aircraft in which the aircraft will be equipped with the slats received from the slats manufacturer and/or from its storage location.

In this case, the flow of parts corresponds to the count of slats stored in the starting containers at the slat production site, in transit and at the assembly site of the aircraft. More specifically, said count is performed for each slat type, for example the number of slats of the "left wing inner slat" type and/or the number of slats of the "left wing middle slat" type.

The system may also be configured to receive the temperature and/or the hygrometry and/or the force and/or the acceleration measured by said respective sensor within the container and transmitted by the controller. The system is configured to notice a risk of damage related to the container, identified by the unique identifier of the container. Said risk of damage is noticed by the receiver if the temperature and/or the hygrometry and/or the force and/or the acceleration measured by said respective sensor exceeds a defined threshold. Advantageously, the system may be configured to trigger an inspection of the container and/or of a content of the container in the case where said risk of damage has been noticed.

FIG. 5 also shows the flow of parts transported within one or more transport container(s) (10). The same transport container (10) may be located at a starting point (210) or at a transit point (230) between the starting point (210) and an end point (220) or at the end point (220). In the case of several containers, each of said containers may be located at one of said positions amongst: starting point, transit point or arrival point. To detect the flow of transported parts, the receiver receives from each container: the identifier of the container, the state of occupancy of each of the holders within said container and the geolocation of said container.

Based on the geolocation, the receiver determines the positioning of the container at the starting point, at the end point or at a transit point. More specifically, the receiver receives from the controller within the container, terrestrial coordinates corresponding to the location of the container. For example, the receiver may have available at its disposal a geolocation of the starting point and a geolocation of the end point. Thus, the receiver may calculate a first distance between the geolocation of the container and the geolocation of the starting point and a second distance between the geolocation of the container and the geolocation of the end point. The receiver may associate the position of the container with the starting point in the case where said first distance is smaller than a first threshold. The receiver may associate the position of the container with the end point in the case where said second distance is smaller than a second threshold. The positioning of the container may be associated with a transit point in the case where the first distance is longer than the first threshold and the second distance is longer than the second threshold.

The positioning of the container may be determined with a 50-metre accuracy or less, preferably with a 10-metre accuracy.

Based on the identifier of the container, the receiver determines the part type that might be present within the container. For example, the receiver has a database grouping together a container identifier with a part type. The identifier of the container may be associated unequivocally with one part type because the specific shape of the holder within the container allows storing only one part type. As described before, the shape of the holder only allows a shape corresponding to the part to be transported in said holder. In the case where several holders are present in the container, the receiver determines, based on the identifier of the container, the part type that might be present in each of the holders. In other words, the receiver determines for each holder which part type is present in the container in the case where the detector indicates a presence of a part.

Based on the state of occupancy of each of the holders within the container, the receiver determines the types of parts that are present within the container. As described before, the information on the presence of a part in a holder together with the identifier of the container allows concluding on the presence of a given part type within the container, thanks to the specificity of the holder for a given part type.

Thus, the receiver can determine the flow of a part type between a starting point and an end point.

FIG. 6 shows an example of flow detection performed by the system. A first column shows a unique identifier (300) received from each container. A second column shows the geolocation of each container. Each container is identified as being located at the starting point (D, 210), in transit (T, 230) or at the end point (A, 220).

In the illustrated example, each container has six holders inside. For each container, the system receives the state of occupancy of each holder. According to the illustrated example, the system receives from the container G-773 the information that this container is located at the end point and that the first, second, fourth, fifth and sixth holders are occupied, indicated by the number "1". The third holder is unoccupied, indicated by the number "0". The system knows, for example based on a database, that the holders within the container G-773 can receive slats of an aircraft of a determined type. Thus, it is known that the first holder can receive only a type 140-L slat, for example the inner slat of the left wing of a type "Cessna Citation CJ4 Gen2" aircraft. For example, the other holders of the container can receive only the other slats present in said aircraft type.

Thus, the system could deduce that the type 260-L slat has been removed from the container. The other slats (240-L, 250-L, 240-R, 250-R, 260-R) are still located in the transport container stored at the end point.

Preferably, said system may also be configured to detect a part returned by a client or a defective part. In other words, based on the information received by the receiver, it is possible to determine a return flow of types of parts to be overhauled or to be repaired. To determine a number of types of parts to be overhauled, the receiver receives the information from the container or containers with a positioning at the end point. In other words, during a first step, the receiver determines a positioning of the container at the end point. Afterwards, the receiver observes the container while it remains at the end point without leaving the end point. During this time, the receiver receives the state of occupancy of each holder of said containers placed at the end point. An empty holder, free of any part, within a container positioned at the end point indicates that the corresponding part has been removed from the holder by the client. Each holder which, at the end point, indicates an absence of a part type and then a presence of said part type is marked as a "return part type" or returned part. Alternatively, if no part has been placed in said holder at the starting point. In the case where this same holder indicates afterwards the presence of a part, this allows deducing that said part has been placed in the holder at the end point. Thus, it is possible to deduce that it consists of a part to be returned, more particularly, a part to be overhauled or a defective part.

Advantageously, said system may also be configured to manage an amount of flow of parts between the starting point and the end point. In other words, the system directs the flow of parts, for example by determining a necessary transfer of transport containers, departing from the starting point. The system may also establish a schedule of parts to be sent per day or of containers to be sent per day or per another unit of time.

To manage said amount of flow of parts, the system determines a number of containers having a positioning at the end point. In other words, the system counts the containers that send a position corresponding to the end point. Afterwards, the system determines for each container located at the end point the number of each part type located at the end point. As described before, each container transmits the state of occupancy of each holder within the container. Based on a database and the identifier of the container, the part type for each holder is known by the system. Thus, the number of each part type may be deduced by knowing the state of occupancy of each holder.

Afterwards, the system compares all of said parts with a threshold. In other words, for each part type, the system compares the amount of types of parts present at the end point with a threshold. In the case where all of said part types are below said threshold, the system may act on the flow of parts. For example, the system may increase the flow of parts from the starting point to the end point. For example, the system may act so as to increase a shipping rate and/or an amount of these containers in transit (230) towards the end point. The system may also increase a provision, for example a production flow, of parts at the starting point. It should be understood that the system may also reduce a flow of parts, for example if all of said part types are above said threshold.

Advantageously, a method for managing a flow of parts could implement the above-described system.

The method may comprise a first step during which the system determines a set of containers with a positioning at an end point. As described before, the system counts the containers that transmit a positioning at the end point.

Afterwards, the system observes within each container positioned at the end point how many states of occupancy change from a presence state into an absence state over a given time period. Thus, the system determines a number of parts that have left the container over the time period or, in other words, a rate of use or consumption of parts. More specifically, the system knows how many parts of each type have left the containers at the end point.

Based on said rate of use, the system could calculate a flow of desired parts from the starting point to the end point. For example, said flow of parts may be adapted to correspond to the speed of use of the parts. It is also possible to adapt said flow in order to increase a stock of parts at the end point or to reduce a stock of parts at the end point.

Said method may also comprise the step of determining, among the containers with a positioning at the end point, a number of states of occupancy displaying an absence state. In other words, the receiver of the system observes the containers that have transmitted a positioning at the end point. For each of said containers, the system counts the holders displaying an absence state. In other words, the system counts the number of holders positioned at the end point which are empty. Based on this information, the system also determines the number of each part type missing at the end point. For each part type, the number of missing parts corresponds to the number of empty holders that could receive said part type. Thus, the system knows how many parts of each type have been used.

In the case where said number is above a given threshold, the system could increase a production of part types corresponding to the holders with said absence state. In other words, for a given part type, the system counts how many empty holders corresponding to this part type are in the containers at the end point. When the number of empty holders exceeds a given threshold, the system increases a production of parts of said type. The system could automatically increase said production.

The invention claimed is:

1. A transport container for a system for detecting a flow of parts, the container comprising:

a first holder comprising a first specific shape for receiving a first part type to be transported, a first detector for detecting an occupancy state of the first holder, a detector of a geolocation of the container, and a controller configured to transmit an identifier of the container together with said state of occupancy of the first holder and said geolocation, wherein the identifier identifies the first specific shape of the first holder and thereby the first part type receivable by the first holder.

2. The container according to claim 1, the container comprising a second holder, the second holder comprising a second specific shape for receiving a second part type to be transported and a second detector for detecting a state of occupancy of the second holder, the first shape being different from the second shape so that the first holder cannot receive the second part type and the second holder cannot receive the first part type, the controller being configured to transmit the state of occupancy of the second holder.

3. The container according to claim 1, wherein the shape that the holder comprises is a negative of a portion of a slat or a negative of a portion of a droop-nose of an aircraft.

4. The container according to claim 1, comprising a plurality of holders, each holder comprising a specific shape so as to be able to receive only a particular part type amongst a set of different part types, each holder comprising a detector of the occupancy of the holder, the controller configured to transmit the state of occupancy of each holder.

5. The container according to claim 4, the container being configured to receive a complete set of slats of an aircraft, each holder comprising a specific shape so as to be able to receive only one slat of the set of slats.

6. The container according to claim 1, wherein the detector of the state of occupancy of the holder comprises a mechanical detector and/or an electromechanical detector and/or an optical detector and/or a weight detector and/or a volumetric detector and/or an ultrasonic detector and/or an electromagnetic ray detector, the detector being configured to detect said part and/or to be actuated by the part upon reception of said part by the holder.

7. The container according to claim 1, wherein the geolocation detector comprises a GPS detector and/or a GSM-TDOA detector.

8. The container according to claim 1, comprising a temperature sensor and/or a hygrometry sensor and/or a shock sensor and wherein the controller being configured to transmit a temperature and/or a hygrometry and/or a force and/or an acceleration measured by said respective sensor.

9. A system for detecting a flow of parts, the system comprising the container according to claim 1 and a receiver configured to receive the identifier of the container with the state of occupation and the geolocation and determining based on the geolocation: a positioning of the container at a starting point or at an end point or at a transit point and/or determining based on the identifier of the container and the state of occupancy:

a presence of a part type, or a presence of all types of parts in the container.

10. The system according to claim 9, comprising a plurality of said transport containers, the identifier of each container being unique within the plurality of containers and associated with one single container.

11. The system according to claim 9, configured to notice a risk of damage related to the container, said container comprising a temperature sensor and/or a hygrometry sensor and/or a shock sensor, wherein the controller being configured to transmit a temperature and/or a hygrometry and/or a force and/or an acceleration measured by said respective sensor, said risk of damage being noticed if the temperature and/or the hygrometry and/or the force and/or the acceleration measured by said respective sensor exceeds a threshold, preferably the system being configured to trigger an inspection of the container and/or a content of the container in the case where said risk of damage has been noticed.

12. The system according to claim 9, configured to detect a part returned by a customer by performing the steps of:

determining a positioning of the container, while the container keeps a positioning at the end point:

determining an absence of a part type in said container and then determining a presence of said part type in said container.

13. The system according to claim 9, configured to manage an amount of flow of parts by performing the steps of:

determining a number of containers with a positioning at the end point and determining the types of parts present in each of said containers, comparing a set of said types of parts with a threshold, increasing a flow of parts from the starting point to the end point if all of said part types are below said threshold.

14. A method for managing a flow of parts implementing the system according to claim 9, the system comprising a plurality of said transport containers, the method comprising the steps of:

determining a set of containers with a positioning at an end point, in said set of containers determining a number of states of occupancy changing from a presence state into an absence state for a given time period, determining a flow of desired parts from the starting point to the end point based on said change.

15. The method according to claim 14, comprising the step of;

determining in said set of containers with a positioning at the end point a number of states of occupancy displaying an absence state, wherein in the case where said number is above a given threshold: increasing a production of part types corresponding to the holders with said absence state.

* * * * *